US005273114A

United States Patent [19]

Wicks, III et al.

[11] Patent Number: 5,273,114

[45] Date of Patent: Dec. 28, 1993

[54] GRAVEL PACK APPARATUS AND METHOD

[75] Inventors: Moye Wicks, III, Houston; Joe O. Esparza, Katy, both of Tex.

[73] Assignee: Shell Oil company, Houston, Tex.

[21] Appl. No.: 894,668

[22] Filed: Jun. 5, 1992

[51] Int. Cl.[5] ..... E21B 43/04; E21B 43/08

[52] U.S. Cl. ..... 166/278; 166/51; 166/177

[58] Field of Search ..... 166/51, 177, 249, 278, 166/286

[56] References Cited

U.S. PATENT DOCUMENTS

| | | | |
|---|---|---|---|
| 2,513,944 | 7/1950 | Kessler | 166/278 |
| 2,730,176 | 1/1956 | Herbold | 166/177 |
| 3,101,499 | 8/1963 | Greenfield . | |
| 3,111,171 | 11/1963 | Ferrar et al. | 166/177 |
| 3,113,621 | 12/1963 | Krueger et al. . | |
| 3,535,927 | 10/1970 | Mahon et al. . | |
| 3,557,875 | 1/1971 | Solum et al. | 166/286 |
| 3,770,054 | 11/1973 | Solum | 166/177 |
| 3,830,294 | 8/1974 | Swanson, Jr. | 166/51 |
| 4,026,150 | 5/1977 | Schmidt . | |
| 4,291,395 | 9/1981 | Holmes | 367/83 |
| 4,323,991 | 4/1982 | Holmes et al. | 367/83 |
| 4,366,988 | 1/1983 | Bodine | 299/14 |
| 4,469,178 | 9/1984 | Solum | 166/278 |
| 4,544,031 | 10/1985 | Bodine | 166/177 |
| 4,665,980 | 5/1987 | Bodine | 166/249 |
| 4,775,016 | 10/1988 | Barnard | 175/56 |
| 4,856,590 | 8/1989 | Caillier | 166/278 |
| 4,964,464 | 10/1990 | Myers | 166/278 |
| 5,009,272 | 4/1991 | Walter | 175/56 |
| 5,036,920 | 8/1991 | Cornette et al. | 166/278 |

OTHER PUBLICATIONS

*Oil Well Screens*, Brochure, produced by Howard Smith Screen Company, Houston, Tex., Sep. 1982.

*Composite Catalog of Oil Field Equipment and Services*, vol. 2, published by World Oil, 1990, p. 3106.

*Primary Examiner*—George A. Suchfield

*Attorney, Agent, or Firm*—Del S. Christensen

[57] ABSTRACT

A wash down placement of a screen into sand within a well borehole is improved by vibration of a wash pipe as the wash pipe is removed from the screen. A compacted sand gravel pack around the screen is achieved. The vibrations are created by constraining a bluff object having a plurality of positions between which flow of fluid forces the bluff object.

11 Claims, 6 Drawing Sheets

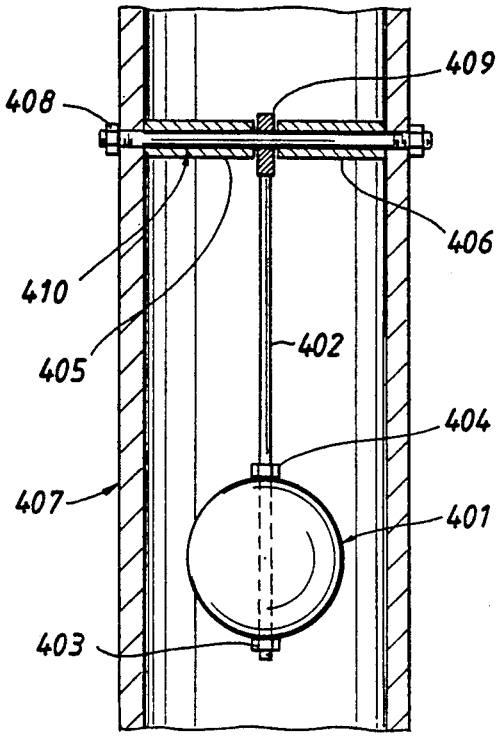
FIG. 5
FIG. 6A
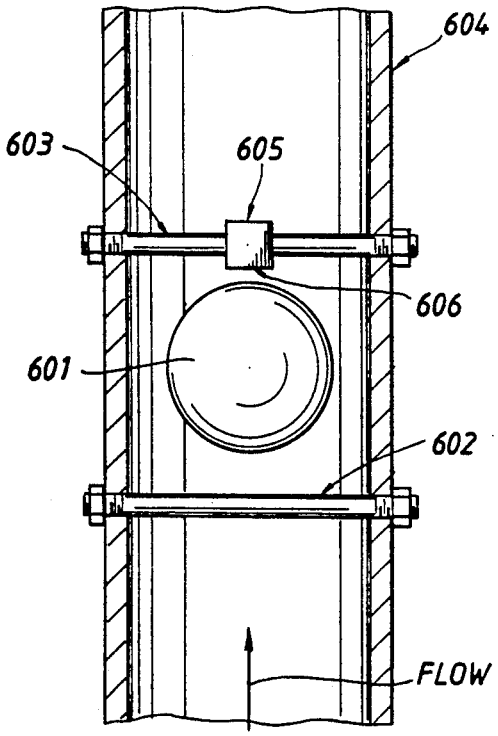
FIG. 6B
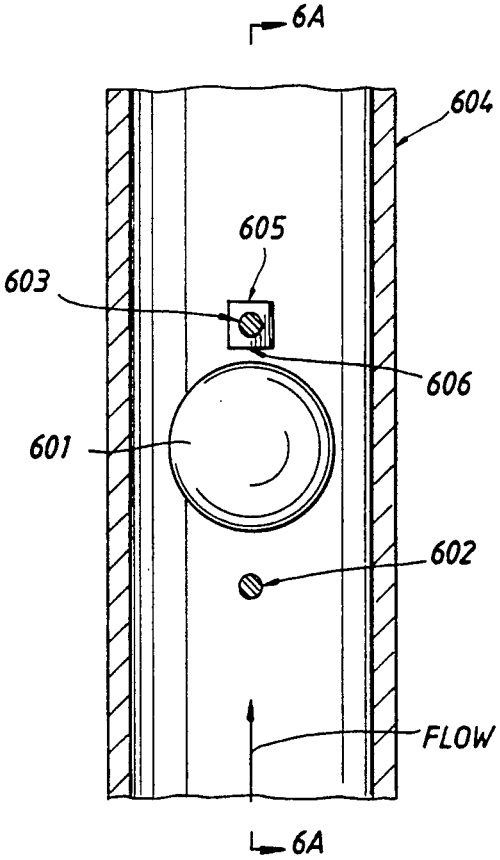

GRAVEL PACK APPARATUS AND METHOD

RELATED PATENTS

This application is related to U.S. patent application Ser. No. 07/894,667, entitled "Fluid Flow Conduit Vibrator and Method", filed on Jun. 5, 1992.

FIELD OF THE INVENTION

This invention relates, in one aspect, to an apparatus and method to place a screen in densely packed sand within a well borehole.

BACKGROUND OF THE INVENTION

Gravel packing of a well borehole involves placing sized gravel or sand within a wellbore external to a screen. The gravel pack sand and screen slots are sized to prevent formation sand migration into the wellbore. Gravel packing is critical to continued oil production from subterranean formations consisting of loosely consolidated or unconsolidated sand. Without an effective gravel pack, the produced sand from the formation will erode equipment and fill tanks and vessels, thus causing the need for shutdowns to clean or replace equipment. Sand can also fill the wellbore and interfere with effective oil lifting. Additionally, displaced sand can leave cavities around the wellbore and thus jeopardize lateral support for well tubulars. Loss of lateral support may result in damage to well tubulars.

The screen is typically hung from a packer and extends downward into a borehole. The borehole can be either cased or uncased. An annulus between the screen and the casing is typically sealed on top and bottom by packers.

Placement of sand around the screen is accomplished by circulating a slurry of sand suspended in a carrier fluid from the surface through a drill string to a crossover tool immediately above the screen. The crossover tool directs the slurry from the drill string to the annulus surrounding the screen. As the slurry travels down the annulus around the screen, some carrier fluid may enter the formation, leaving sand deposited at the perimeter of the wellbore or perforations. The remaining carrier fluid will pass through the screen. The screen has openings that are sized to retain the sand outside of the screen. Sand will therefore be filtered from the slurry by the screen and remain in the annulus outside of the screen. A wash pipe is usually provided within the screen extending from the crossover tool to near the bottom of the screen. Returning carrier fluid, after passing through the screen, enters the wash pipe at the lower end of the wash pipe, and travels up the wash pipe to the crossover tool. The crossover tool directs this returning carrier fluid to the annulus outside of the drill pipe, above the screen packers, and up to the surface.

After the annulus between the screen and the borehole (or the casing if a cased borehole is to be gravel packed) is filled with sand, the crossover tool is disconnected from the screen, and removed from the wellbore. The screen is left suspended from packers, surrounded by gravel pack sand. A production tubing is then run to the inside of the screen, along with artificial lift means, if required.

A crossover tool is provided to the gravel pack assembly as it is installed in the well. The crossover tool is a removable mechanism attached to the gravel pack packer which directs fluid flow while placing the gravel pack slurry. Slurry is pumped into the drill pipe down the wellbore. The slurry is diverted into the screen annulus via the crossover tool once the slurry reaches the gravel pack packer. The slurry is transported down the screen annulus. As this occurs some may enter the formation and some may enter the screen. Since sand cannot pass through the screen, it is deposited in the screen annulus. Carrier fluid that enters the screen may return up a wash pipe which is installed inside the screen. Fluids returning up the wash pipe are diverted into the drill pipe/casing annulus above the gravel pack packer via the crossover tool to return to surface.

An alternative way to provide a gravel pack around a screen is to first fill the borehole with sand, and then sink the screen into the sand. This has been accomplished by providing an auger at the bottom of the screen and along the length of the screen. The screen is then "screwed" into the sand. A substantially studier screen is required, and the depth to which the screen may be placed within the sand is limited.

Another method to sink a screen into sand which has been placed in a borehole is to fluidize the sand from the bottom of the screen by passing fluids through a wash pipe to an outlet at the bottom of the screen. This is known as a "wash down" method.

Methods which sink the screen into previously placed sand require simpler tools because the cross over tool is not required. But, providing a dense sand pack with these prior art methods is not possible. The wash-down method fluffs the sand as the screen is lowered, and the auger method lifts sand and can create voids near the screen.

To be effective, the gravel pack must comprise densely packed sand without voids or cavities in the sand. If portions of the annulus around the screen are not packed completely with sand, formation fluids containing formation sand will quickly erode the screen, leading to a gravel pack failure. Further, if the gravel pack initially is not densely packed, subsequent compaction caused by, for example, flow of the formation fluids, can result in voids and cavities within the gravel pack.

Known methods to increase the density of gravel packs include pulsing the flow of the return fluid as disclosed in U.S. Pat. No 3,830,294. Pulsing of the fluid flow is helpful in increasing the density of the gravel pack, but merely pulsing the flow imparts a limited amount of energy into the gravel pack, and can have deleterious effects, such as fracturing the formation. Other methods to pulse flows of drilling fluids have been developed for the purpose of transmitting information to the wellhead. These are described in, for example, U.S. Pat. Nos. 4,291,395, 4,323,991, 4,775,016 and 5,009,272. Like '294, these methods may not impart a significant amount of energy into a gravel pack.

A method to vibrate a drillstring and gravel pack apparatus by imparting a sonic frequency vibration which may be a resonant frequency at the wellhead is disclosed in U.S. Pat. Nos. 4,599,031 and 4,665,980. This method would be useful if the drill pipe did not have significant contact with the wellbore or casing above the gravel pack. Unfortunately, this is rarely the case. Wellbores inherently drill in a corkscrew configuration. A drill pipe is therefore in frequent if not almost continuous contact with the wellbore walls or casing. Vibrations imparted at the wellhead can therefore be significantly dampened, and vibrations of only a small magnitude may be present at the gravel packing apparatus. It would be preferable to impart vibrations at the gravel packing apparatus directly to minimize dampening of the vibrations, and to utilize more efficiently the energy to impart these vibrations.

U.S. Pat. No. 3,113,621 discloses the use of known vibration imparting tools to well liners to add gravel to a wellbore through the liner by vibrating larger sand particles through the liner than can return into the liner without vibration. The method to impart the vibration requires using known electrically driven or hydraulically driven vibrators. Thus, a 10 to 100 horsepower motor, along with a power source, must be inserted into the wellbore It would be preferably to impart such vibration with a more simple, less expensive, and more compact source of vibration.

Bluff objects are known to shed vortexes at rates which can be proportional to the flow rate of fluid passing the bluff object. This phenomena is utilized in flow rate measuring devices disclosed in, for example, U.S. Pat. Nos. 3,535,927, 3,927,566 and 4,026,150. U.S. Pat. No. 3,927,566 further discloses the use of vortex shedding of one bluff object to move a second bluff object up and down. The second bluff object is located immediately downstream of the first bluff object The frequency of the up and down movement of the second bluff object is, according to Birkoff's Theory, proportional to the rate of flow of the fluid past the bluff objects. Although the second bluff object could impact the walls of the flow conduit, such impacting would render the device unreliable as a flow measurement device and thereby defeat the intended purpose of the invention.

It is therefore an object of the present invention to provide a method and an apparatus to provide a dense sand pack surrounding a screen within a wellbore. It is a further object to provide such a method and apparatus wherein sand is deposited within the wellbore before and the screen is then sunk into the sand.

SUMMARY OF THE INVENTION

The objects of the present invention are accomplished by a method comprising the steps of: placing sand within the wellbore; providing a screen comprising a cylindric sieve capable of separating the sand from a carrier fluid, a wash pipe within the sieve extending to an opening at a lower end of the screen removably connected to the screen at the opening, at least one movable bluff hammer constrained within the wash pipe capable of moving between a plurality of positions abutting the wash pipe wherein the fluid flow through the wash pipe causes the bluff hammer to move between positions, and a means to prevent sand from penetrating the opening at the lower end of the screen; passing a fluid through the wash pipe and out the opening at the lower end of the screen at a rate sufficient to fluidize the sand within the borehole; sinking the screen in the sand as the fluid is being passed through the wash pipe and as sand around the screen becomes fluidized by the fluid flowing through the wash pipe; and removing the wash pipe from the screen while circulating an amount of fluid through the wash pipe sufficient to impart vibration by impacting the bluff hammer on the wash pipe.

The apparatus of the present invention is the gravel pack screen of the method containing the movable bluff object and the opening of the lower end.

Vibration of the wash pipe as it is removed from the screen results in a nearly perfect sand compaction, i.e. the degree of compaction the mixture would have after infinite vibration. The densely placed gravel pack is immune to subsequent settling and minimizes the possibility of bypassing formation solids through the gravel pack.

Simulated gravel packs prepared by the method of this invention were found to be sufficiently dense that subsequent vibration applied from outside the apparatus did not further compact the gravel pack.

In a preferred embodiment, when the borehole is perforated prior to the placement of sand, the borehole is maintained in an overbalanced condition as the screen is lowered into the sand. Fluidized sand will then penetrate the perforations and the fluid will penetrate the formation, leaving the perforation packed with sand.

BRIEF DESCRIPTION OF THE DRAWINGS

FIG.

FIGS. 3 through 6A and 6B each display a means to constrain the bluff object of the present invention.

DETAILED DESCRIPTION OF THE INVENTION

Figure 1A:
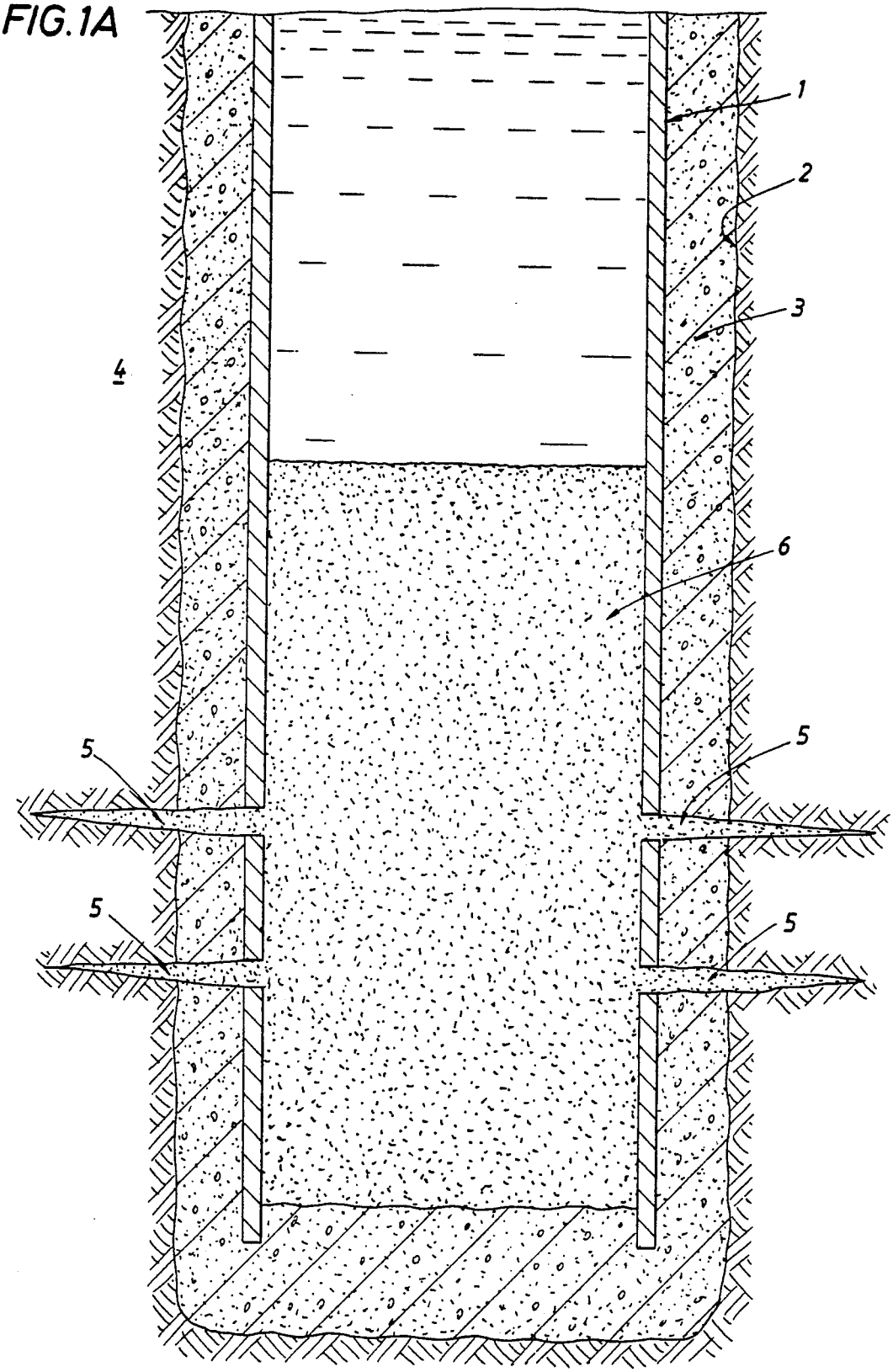
FIGS. 1A through 1D display steps of the process of the present invention.

Applicants have found that constraining a bluff movable object within a fluid flow path is a simple and reliable method to impart vibrations to a wash pipe when fluid is forced through the wash pipe. The bluff object is preferably a round ball made of a relatively dense and hard material such as steel. A bluff object of greater density imparts greater kinetic energy to the wash pipe when it impacts the wash pipe. The bluff object serves in this invention as a hammer by pounding on the wash pipe as forces caused by the fluid flow move the ball back and forth. Other shapes of bluff objects may also be utilized, but round hammers are preferred.

The bluff hammer must be constrained so that it is not carried by gravity or by the fluid flow down the wash pipe from the point where vibrations are desired. The bluff hammer must further be constrained in such a way that it can occupy a plurality of positions. The fluid flow must force the bluff hammer from one position to another, with the direction of movement changed after the impact of the bluff hammer on the wash pipe. In order for the fluid flow to force the bluff hammer from one position to another, the bluff hammer must be constrained by a means that does not create a preferred position to which fluid flow forces the bluff hammer. In one embodiment, a constraint such as a rod pivotally attached to the flow conduit may be used. The rod is preferably considerably longer than the radius of the wash pipe to permit the bluff hammer to impact opposing walls of the wash pipe without the bluff hammer moving through a large arc. Movement through a large arc would require a significant portion of the movement to be against the flow of the fluid. This would be undesirable due to a resultant decrease in momentum prior to the hammer impacting the wall of the wash pipe. The distance from the pivot point to the centroid of the hammer (i.e. the radius of the arc) is preferably greater than 10 times the maximum clearance between the hammer and the inner wall of the wash pipe. Even a large arc radius will result in some movement against the flow of fluid in the wash pipe, but this movement is sufficiently small to result in negligible impact on the momentum of the bluff hammer with the preferred pivot arc radius.

A preferred constraint for the bluff hammer is a plurality of pins traversing the fluid flow conduit in a plane which is essentially perpendicular to the axis of the conduit. The pins are preferably parallel, and are close enough together that the bluff hammer cannot pass between the pins. In a preferred configuration of this embodiment, pins are each placed the same distance from the center of the flowpath. These pins then serve as a track, permitting the bluff hammer to slide back and forth between the walls of the flow conduit. In one embodiment tested two pins perpendicular to the direction of fluid flow were placed at a distance from the center of a spherical steel hammer which resulted in each being at a position 45 degrees from the centroid of the hammer.

Parallel pins in a plane perpendicular to the fluid flowpath provide a continuous series of positions which the hammer may occupy. The movement against the normal flow of the fluid may be constrained so the hammer does not move from the position at which vibration is desired during, for example, reverse flow periods. The movement against the normal flow may be constrained by a seat in which the bluff hammer might rest, preventing further axial movement.

Another constraint for the bluff hammer may be a perforated plate orientated perpendicular to the fluid flow. The perforations are sufficiently small that the bluff hammer cannot pass through the perforations.

Another method to constrain the bluff hammer would be to attach the bluff hammer to a flexible cable or wire. The flexible cable or wire is then attached to the wall of the wash pipe thus constraining movement of the bluff hammer. The length of the wire or cable is preferably greater than about 20 times the distance between points where the bluff object impacts the walls of the wash pipe. A length of cable or wire this long or longer limits the bending moment of the wire or cable and therefore increases the useful life of the apparatus.

The present invention is not limited to a single bluff hammer. A plurality of hammers could be provided. These hammers could be constrained either within a common volume, or constrained within separate volumes such that they will not impact each other. For example, a series of two to four steel balls could be strung on a cable, and the cable affixed to a stationary point in the wash pipe. Alternatively, a steel ball may be placed on each end of a rod, and the rod pivotally mounted between the balls. The rod is mounted axially with the fluid flow. When multiple bluff bodies are incorporated, they may be identical to each other or they may differ in respect to shape, size and/or weight. They may also differ in the method of constraint.

In the preferred embodiment of this gravel packing tool, a single bluff hammer is located near the bottom of the wash pipe. As the wash pipe is removed from the screen, it will vibrate the sand along the entire length of the wash pipe.

A bluff object can be round, but may also be any object which is not "streamlined", as explained in U.S. Pat. No. 3,927,566, column 1, line 55 to column 2, line 6.

Referring to FIGS. 1A through 1D, a cross sectional view of a gravel packing apparatus in a typical wellbore is shown. A casing 1 is secured in wellbore 2 by cement 3 in a well borehole, 4. The casing, cement and formation have been perforated and therefore contain perforations, 5. In FIG. 1A, sand, 6, has been placed within the borehole. The sand may be place by circulation of a slurry containing sand to near the bottom of the borehole, and then allowing the sand to settle from the slurry. The bottom of the borehole can be maintained in an overbalanced condition during the time period the sand is allowed to settle from the slurry. Maintaining the borehole bottom in an overbalanced condition forces some slurry into the perforations and aids in packing of the perforations.

Figure 1B:
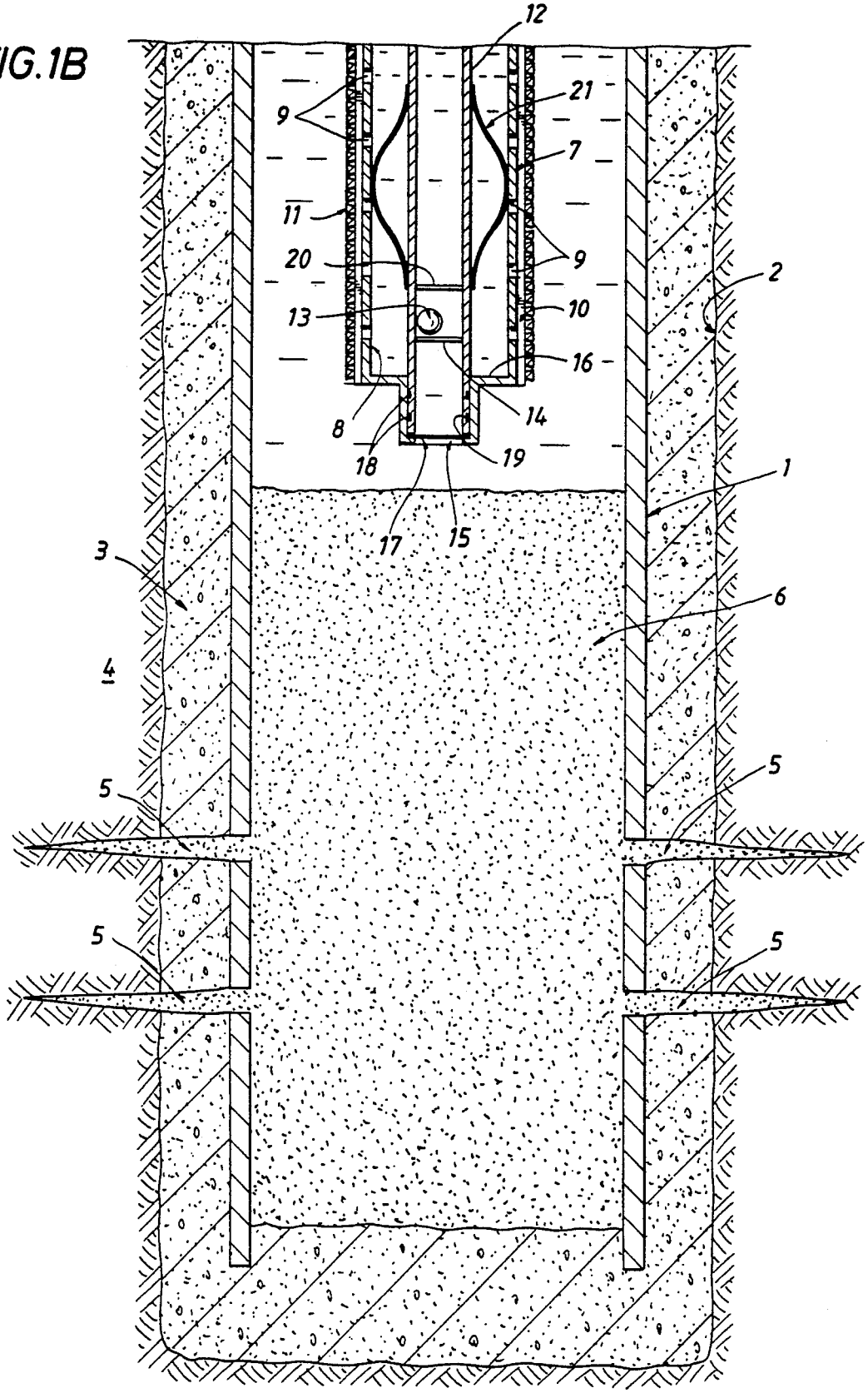

FIG. 1B shows a screen, 11, with a wash pipe being lowered into the sand. The screen, 11, comprises a pipe, 8, with holes, 9, for communication of fluids from outside the screen to the inside of the screen. Vertical spacer bars, 10, maintain clearance between a wire screen, 11, and the pipe, 8. The wire screen, 11, can be a wire wound around the vertical spacer bars leaving a clearance between each wrap which is less than the diameter of most of the sand particles. The wire screen serves as a sieve to keep the sand outside of the screen. Other types of screens are known, and may be utilized in the practice of the present invention. For example, slots of widths of 20 to 60 microns can be cut in a pipe. This is known as a slotted liner.

A wash pipe, 12, is within the screen. Vibrations are imparted to the screen and in general to the borehole contents by a steel ball, 13, constrained within the wash pipe, 12, by bars, 14, and wash pipe, 12. The inside of the wash pipe is in communication with the outside of the screen by an opening, 15, at the bottom of the screen. The wash pipe, 12, is removably inserted in a collar, 16, which serves to seal the bottom of the screen other than the opening, 15, that is in communication with the wash pipe inside. A seal between the wash pipe, 12 and the collar, 16, may be made by including O-rings, 18, in slots, 19, on the outside of the wash pipe, 12, at the lower end where the wash pipe, 12, slides into the collar, 16. A wire mesh, 17, may cover the opening to prevent sand from intruding into the screen after the wash pipe is removed. Other means to prevent sand from flowing into the screen may also be used, such as a chack valve or flapper which closes when the wash pipe is removed (not shown).

As the screen, 7, is lowered into the sand fluid is circulated down the wash pipe, 12, and out the opening, 15, at the bottom of the screen. This fluid is preferably a brine which will not damage the permeability of the formation, and will be sufficiently dense to provide a slight overbalanced pressure at the bottom of the borehole. An overbalanced pressure is a pressure within the borehole which is greater than the formation pore pressure. Borehole fluids will therefore have a tendency to penetrate into the formation through the perforations, 5.

The rate at which fluids are circulated down the wash pipe, 12, is great enough to fluidize sand, 6, surrounding the screen, 7. This rate will depend on the viscosity and density of the fluids, the size and density of the sand, the borehole and screen dimensions, and the rate at which fluids leak off into the formation through the perforations. Generally, rates which result in a velocity up the borehole around the screen of about 0.003 to about 0.03 feet per second will be sufficient for 20 mesh to 20 mesh gravel. Technology to predict the required fluidization velocity is well known. See, for example, Kunii, D., and O. Levenspiel, "Fluidization Engineering", R. E. Krieger Pub. Co., New York, 1977, pp. 72–73. The fluid velocity limit beyond which particle entrainment will occur can likewise be predicted using known technology: see, e.g., Clift, R., J. R. Grace, & M. E. Weber, "Bubbles, Drops, & Particles", Academic Press, New York, 1978, pp. 109-116.

Figure 1C:
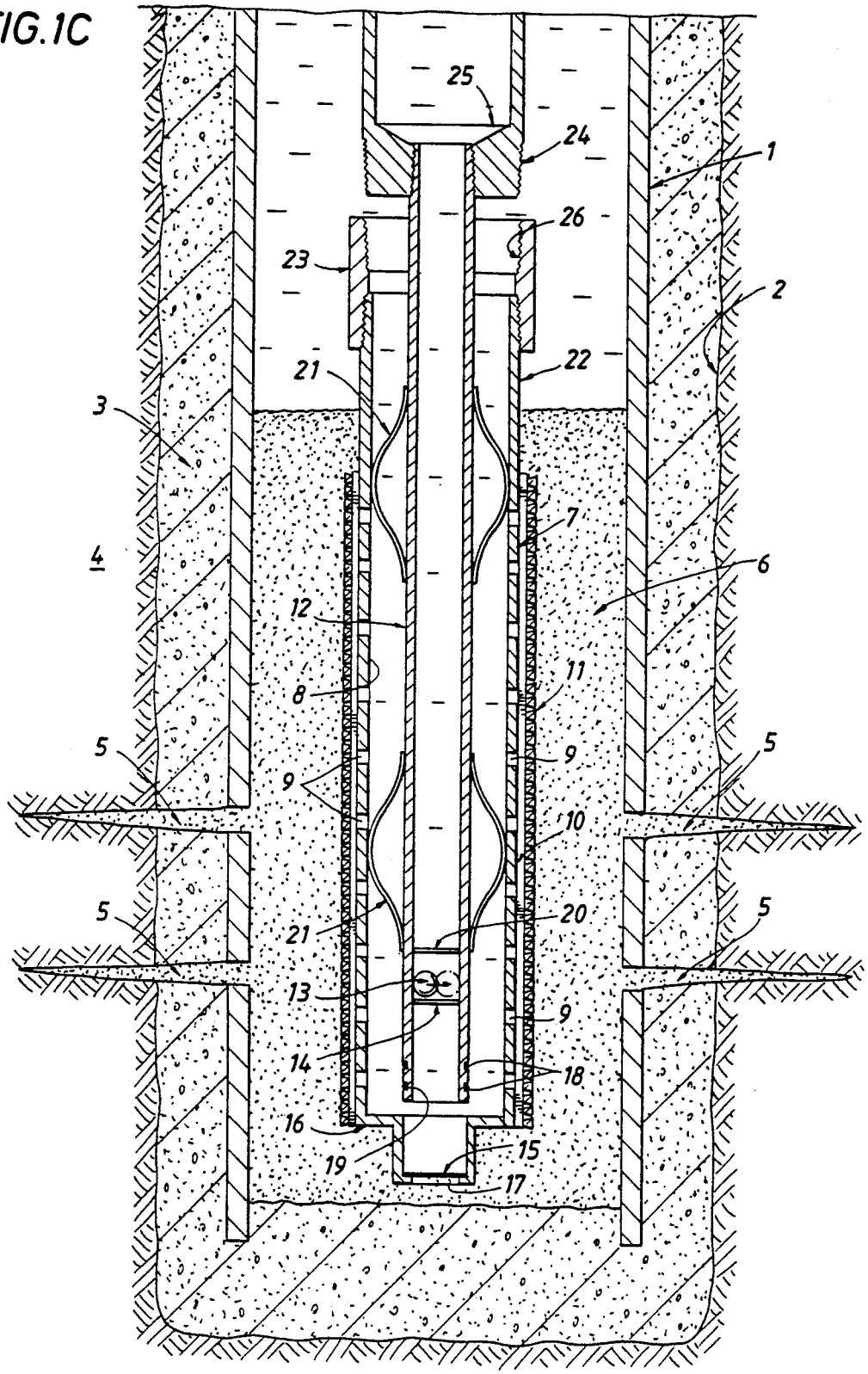

FIG. 1C shows the wash pipe, 12, being removed from the screen, 7. As the wash pipe is lifted from the screen, fluids are circulated through the wash pipe to cause the steel ball, 13, to bang against the walls of the wash pipe, 12, causing a vibration which settles the sand around the screen, 7. Centralizers, 21, may be utilized to keep the wash pipe, 12, centralized within the screen as the wash pipe is being lifted from the screen.

Most of the fluid circulating through the wash pipe will rise through the inside of the screen due to the relatively high resistance to flow created by the gravel surrounding the screen. But unless the inside of the screen is blanked, some fluid will exit the screen and rise through the gravel pack. This fluid interferes somewhat with settlement of the gravel pack. This interference can be avoided by inserting a blank pipe inside of the screen. This blank pipe can be lifted out after the wash pipe is lifted out to then permit production of oil through the screen. This blank pipe can, for example, have tabs at the top protruding inward toward the wash pipe, and tabs protruding outward from the lower portion of the wash pipe to catch the tabs on the blank pipe. The wash pipe would then lift out the blank pipe after the gravel pack is compacted around the screen.

The screen is removably connected to a drill pipe, 24, from which it is suspended as it is lowered into the borehole and into the sand. The wash pipe, 12, is separately connected to the drill pipe by, for example, a coupling, 25. The coupling, 25, may provide for removal of the drill pipe from the screen by a threaded connection, 26. A top collar, 23, is shown to removably connect a threaded top of the screen to the coupling, 25. A blank section of pipe, 22, is provided above the sieve portion of the screen to provide for a level of sand above the sieve portion, but below the point where the drill pipe is removably connected to the screen.

Figure 1D:
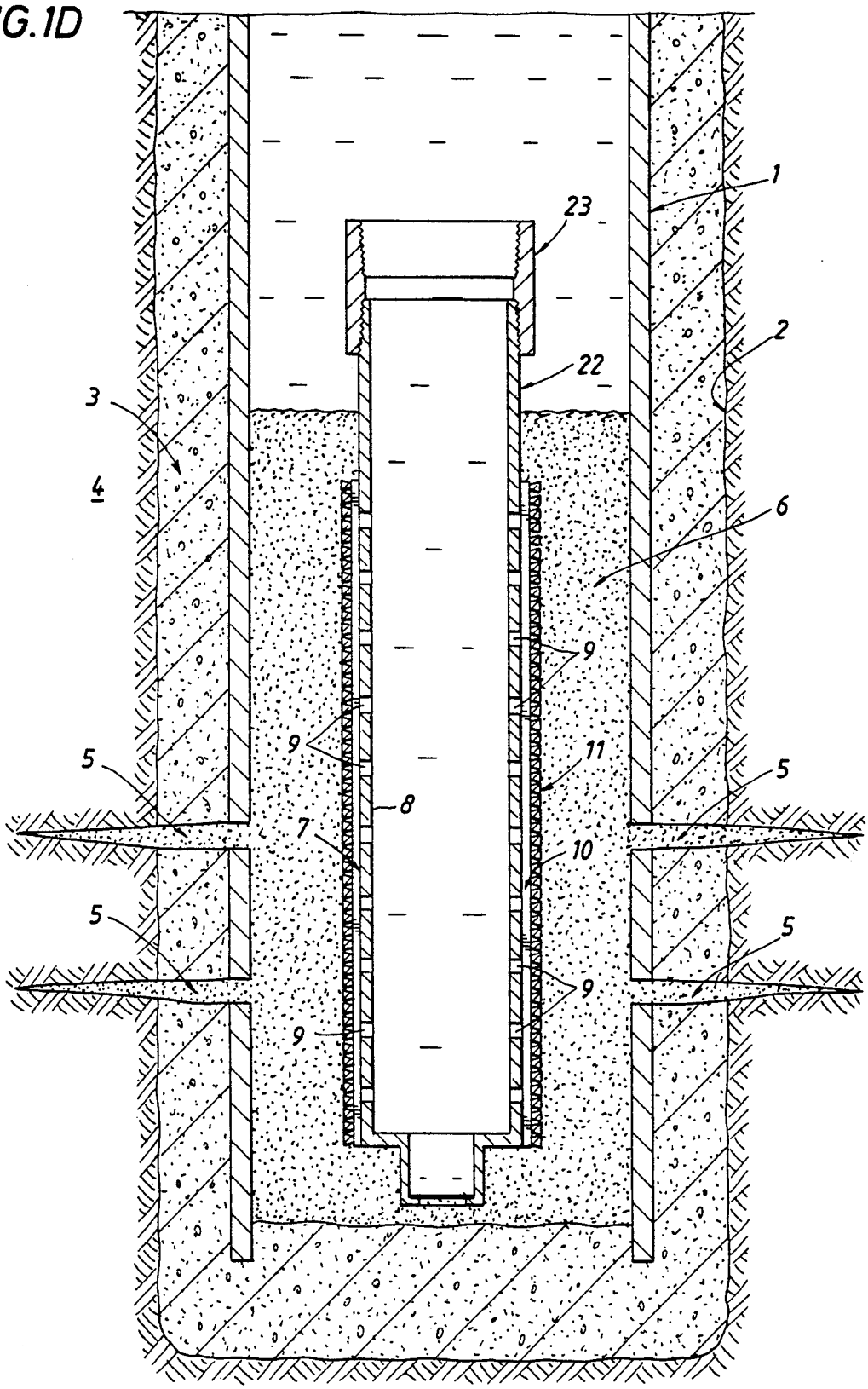

FIG. 1D shows the screen set within the borehole in compacted sand. A production tubing and any necessary artificial lift means (not shown) can be placed in the well to permit production from the well after the wash pipe is removed.

Figure 3:
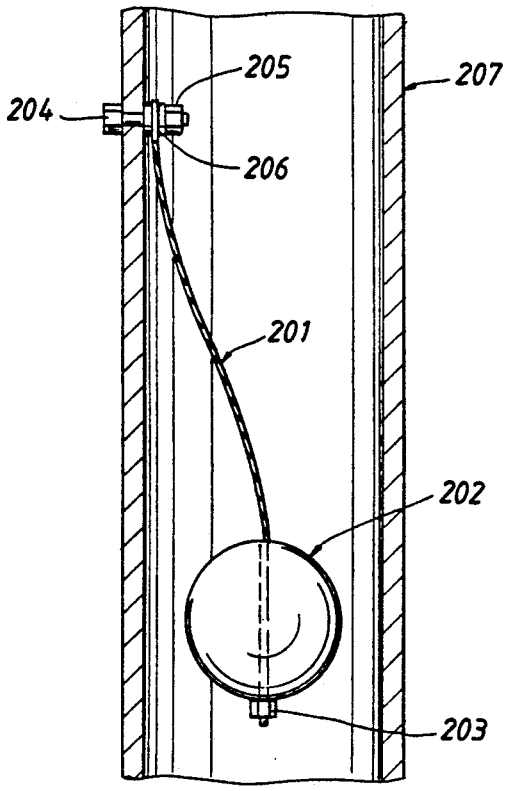

FIG. 3 shows an embodiment of the present invention where movement of a bluff hammer is constrained by a cable, 201. The cable, 201, extends through a hole in a ball, 202, which serves as the bluff hammer. The cable is secured to the wall of the wash pipe by a metal clamp, 203, after the cable passes through a hole in the ball. The cable is secured to the wall of the wash pipe, 207, by a bolt, 204, nut, 205, and washer, 206.

Figure 4:
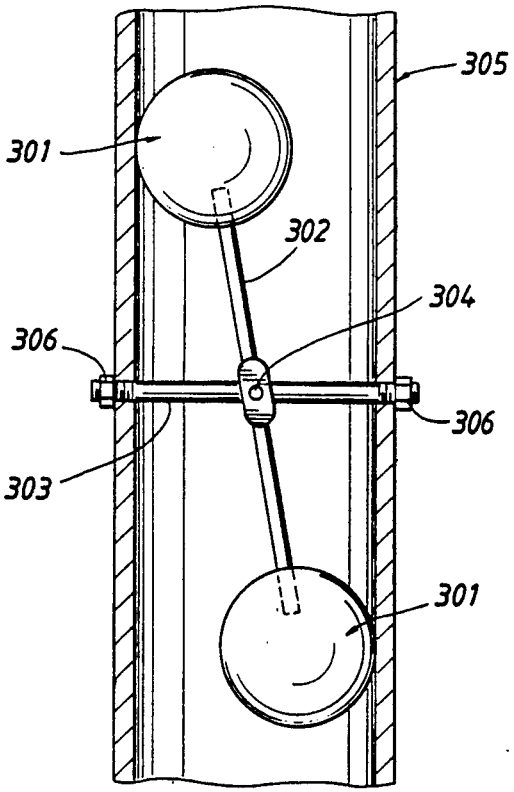

FIG. 4 shows an embodiment of the present invention where two balls, 301, are attached to opposing ends of a rod, 302 which is pivotally mounted at about the center of the rod. The pivotal mounting is shown as a pin, 303, which passes through a reinforced hole, 304, in the rod, 302. Each end of the pin, 303, may be secured outside of a wash pipe, 305, by nuts, 306, which are threadably connected to the pin. In FIG. 4. the balls are attached to the rod by threaded female connections within the ball. Alternatively, the rod may be connected to the ball by a weld, or strap.

FIG. 5 shows a preferred method to constrain a bluff hammer. The movement of the bluff hammer, ball 401, is constrained by a pivoting rod, 402. The ball is shown connected to the pivoting rod, 402, by two nuts, 403 and 404, threaded onto the rod, 402, on either side of the ball, 401. Of course, the nut, 404, is optional because centrifugal force and fluid drag will maintain the ball against the outer nut, 403. Due to vibrations which will occur during normal operation of this gravel packing tool, each nut is preferably secured by a lock washer or a cotter pin through a hole within the threads of the threaded rod (not shown), or by welding the nut in place. FIG. 5 shows a pivoting end of the rod, 402, connected to a washer or bearing, 409, swinging freely on a pin, 410. The washer or bearing, 409, may be kept substantially centered within the flow channel by two sleeves, 405 and 406, one on each side of the washer or bearing. The pivot pin, 410, can be secured to the walls of the wash pipe, 407, by nuts, 408, thread on the pin, and against the wash pipe, 407. A hammer constrained by such a method will generally vibrate whether the fluid flow is in the direction of from the pivot point to the hammer of from the hammer to the pivot point.

FIGS. 6A and 6B show another preferred embodiment where the sphere is allowed to "ride" on a target on the downstream side as shown. The bluff object, a loose ball, 601, is constrained within a wash pipe, 604, from upflow movement by an upstream restraining pin, 602. The flow shown in FIG. 6 is in an upward direction, as it would be in a gravel packing apparatus wash pipe. The top pin is therefore the downstream pin and the bottom pin is the upstream pin. Movement downstream is restrained by a downstream pin, 602. The downstream restraining pin, 602, includes a restraining target, 605. The restraining target provides an essentially flat disc, 606, on which the loose ball can slide between wall contacts.

Figure 2:
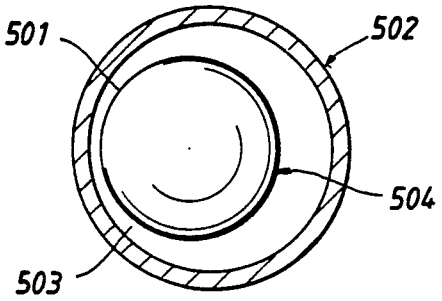
FIG. 2 shows a view along the axis of a fluid flow conduit of the present invention.

The reason a bluff object with constrained movement along an axis of fluid flow will move back and forth is shown by FIG. 2. FIG. 2 is a cross-sectional view of a bluff hammer, in a cylindrical fluid flow path looking along the axis of flow. The bluff hammer, a ball 501, is off-center within the cylinder, shown as a pipe, 502. Fluids will flow around the bluff object taking a path of least resistance. The half of the ball closest to a wall of the pipe, 503, will be exposed to moving fluids of a lower velocity than that of the half of the ball not farthest from the pipe wall, 504. Because of the laws of fluid mechanics the pressure exerted on the ball by the fluid will be greater on the side closest to the wall due to the lower fluid velocity on that side of the ball. A familiar example of this law is referred to as Bernoulli's theorem which states that for an ideal fluid flowing along a streamline, pressure head, velocity head, and elevation head are conserved. Thus, lower velocity regions exhibit higher pressures and higher velocity regions exhibit lower pressures. A ball in a position next to a wall of a flow chamber will therefore be subjected to a lateral force by pressure exerted by the fluid, urging the ball toward the center of the pipe. Although this force reverses itself as the ball passes the center, momentum of the ball will carry it to the wall if the movement is not otherwise constrained. A nearly elastic collision with the wall will reverse the direction of movement of the ball, sending it toward the side of the pipe originally closest to the ball. Although round balls are shown as the bluff hammer in the drawings, and a wash pipe of a round cross section is shown, it can be seen that the present invention is in no way limited to these particular shapes. A round ball is a convenient hammer due to the impact on the wash pipe wall being uniform regardless of the orientation of the hammer.

For a round ball within a pipe of a circular cross section, the frequency of the impacts on the pipe walls has been found to be conveniently estimated by the following equation.

$$Str = \left[ \frac{\frac{3}{4} C_1 K + Fr}{4\pi^2(\rho_b/\rho_f + \frac{1}{2})} \right]^{\frac{1}{2}}$$

where:

$$Str = \text{Strouhal Number} = F\frac{\sqrt{d(D-d)}}{V_{avg}}$$

$$Fr = \text{Froude Number} = \frac{g_c d}{V_v}(\rho_b/\rho_f - 1)$$

F=Ball vibration frequency
d=ball diameter
D=Pipe inside diameter
$V_{avg}$=flow velocity average within cross-section at ball center $$Q/\left[\frac{\pi}{4}(D^2 - d^2)\right]$$

where
Q=total volumetric rate of flow
C1=lift coefficient on the ball
K=constant=1.299
$g_c$=acceleration due to gravity
$\rho_b$=ball density
$\rho_f$=fluid density The energy imparted by the ball to the walls of the wash pipe comes at the expense of pressure drop in the fluid flow. This pressure drop can be estimated for a ball in a cylindrical pipe by the following equation:

$$\Delta P = \frac{f\rho_f(1 - d/D)\,V\text{avg}^2}{2\,g_c}$$

where ΔP is the pressure drop imparted by the vibrating ball of this invention and f is a friction factor which can be estimated as:

$$f = \frac{595.7\ M\mu}{(D-d)\,V_{avg}\,\rho_f} + 0.1096$$

where Mu is the fluid viscosity.

A correlation to define the lift coefficient, $C_1$, for the ball within a pipe is not presently known, but it could be easily determined by back-calculation using experimentally measured frequencies and known rates of flow. In general, it is expected that $C_1$ will depend on the Reynolds Number in the gas $(D-d)\,V_{avg}\,\rho_f/M\mu$. For data obtained with water $C_1=1$ gives a good fit of the observed vibration measurement.

From the above equations it can be seen that the choice of the relative size of the bluff hammer and the wash pipe may be made considering factors such as the frequency of vibration desired, the energy to be imparted by way of the vibrations, and the tolerable fluid flow pressure drop. The bluff hammer preferably is of an average diameter of about ¾ to ⅞ of the flow conduit average diameter. A hammer of this size imparts a desirable frequency and amplitude of vibration.

Fluidization of sand around the screen requires that the borehole be generally vertical. Deviations of up to 24 degrees from vertical are acceptable, and deviations less than about 16 degrees are preferred. Significantly more deviation results in incomplete fluidization while the wash pipe is being lowered into the sand.

EXAMPLE

A simulated gravel pack was performed by placing a gravel pack sand in a vertical clear plastic tube. The tube had a 6.02 inch inner diameter, and was about 18 feet long. The sand filled the tube to a height of about 6 feet from the bottom. The tube was then filled with water. A wire-wrapped screen having a 1.94 inch outer diameter was fitted with a 1.00 inch inner diameter wash pipe extending through the screen and sticking out the bottom of the screen. The area between the wash pipe and the bottom of the screen was sealed with an O-ring fitted on a plastic sleeve. A wire mesh was placed over the end of the plastic sleeve so that sand could be kept out of the screen after the wash pipe was removed. A 23/32 inch diameter steel ball was constrained within the wash pipe about 18" from the bottom by dowels inserted through the wash pipe. A metal tube similar to a base pipe but without perforations (1.375 ID×1.50" OD×10' long) was fitted inside the screen and external to the wash pipe.

The screen was placed in the plastic tube, resting on the sand. Water was then circulated through the wash pipe at a rate of about 8 gpm. Sand around the bottom of the screen fluidized, and the screen sunk into the sand. It took about 15 seconds for the screen to reach the bottom of the tube. The wash pipe was then disconnected from the screen and raised as water was redirected and circulated through the wash pipe and internal to the base pipe, stopping fluidization of the gravel. The wash pipe was raised at a steady rate, taking about 120 seconds to clear the top of the sand. A definite vibration could be felt from the surface of the plastic tube when water was circulated through the wash pipe.

After the wash pipe was sunk to the bottom of the plastic tube, the height of the sand indicated a sand density similar to the initial sand density. After the wash pipe was removed, the height of the sand indicated about 8 percent greater sand density. This increase in density is similar to the increase in density which is observed when a beaker of sand and water is vibrated until the density of the sand no longer increases.

The foregoing description of the invention is merely intended to be explanatory thereof, and various changes in the details of the described method and apparatus may be made within the scope of the appended claims without departing from the spirit of the invention.

We claim:

1. A gravel packing screen capable of being inserted into a sand filled portion of a borehole comprising:
   a) a cylindrical sieve capable of separating the sand from a carrier fluid;
   b) a wash pipe within the sieve extending to an opening at a lower end of the sieve removably connected to the sieve at the opening;
   c) at least one movable bluff hammer constrained within the wash pipe capable of moving between a plurality of positions abutting the wash pipe wherein fluid flow through the wash pipe causes the bluff hammer to move between positions; and
   d) a means to prevent sand from penetrating the opening at the lower end of the sieve.

2. The gravel packing apparatus of claim 1 wherein the hammer is an essentially round ball.

3. The gravel packing apparatus of claim 1 wherein the movement of the hammer is constrained by an anchor rod affixed to the hammer at one end and pivotably affixed at the other end to the wash pipe.

4. The gravel packing apparatus of claim 1 wherein the hammer is constrained by a flexible cable affixed to the hammer at one end and affixed at the other end to a stationery position within the wash pipe.

5. A method of placing a screen in densely packed sand within a wellbore comprising:

placing sand within the wellbore;

providing a screen comprising a cylindric sieve capable of separating the sand from a carrier fluid, a wash pipe within the sieve extending to an opening at a lower end of the screen removably connected to the screen at the opening, at least one movable bluff hammer constrained within the wash pipe capable of moving between a plurality of positions abutting the wash pipe wherein the fluid flow through the wash pipe causes the bluff hammer to move between positions, and a means to prevent sand from penetrating the opening at the lower end of the screen;

passing a fluid through the wash pipe and out the opening at the lower end of the screen at a rate sufficient to fluidize the sand within the borehole; sinking the screen in the sand as the fluid is being passed through the wash pipe as sand around the screen becomes fluidized by the fluid flowing through the wash pipe; and removing the wash pipe from the screen while circulating an amount of fluid through the wash pipe sufficient to impart vibration by impacting the bluff hammer on the wash pipe.

6. The method of claim 5 wherein the well borehole deviates from vertical by about 25 degrees or less.

7. The method of claim 6 wherein the well borehole is essentially vertical.

8. The method of claim 5 wherein the well borehole is a perforated well borehole.

9. The method of claim 8 wherein the well borehole is a perforated borehole.

10. The method of claim 5 wherein the borehole bottom pressure is maintained above the formation bore pressure during at least a portion of the time when the wash pipe is being removed from the screen.

11. The method of claim 5 wherein the borehole bottom pressure is maintained above the formation pore pressure during at least a portion of the time when the screen is being sunk into the sand.

* * * * *